US005367787A

United States Patent [19]

Ikeda et al.

[11] Patent Number: 5,367,787

[45] Date of Patent: Nov. 29, 1994

[54] DRYING MACHINE

[75] Inventors: Tomohiko Ikeda, Kusatsu; Toshiaki Sakamoto, Shiga, both of Japan

[73] Assignee: Sanyo Electric Co., Ltd., Osaka, Japan

[21] Appl. No.: 102,307

[22] Filed: Aug. 5, 1993

[30] Foreign Application Priority Data

Aug. 5, 1992 [JP] Japan ..... 4-209143

[51] Int. Cl.[5] ..... F26B 19/00

[52] U.S. Cl. ..... 34/549; 34/494; 34/77; 34/477

[58] Field of Search ..... 34/467, 468, 493, 494, 34/497, 499, 549, 73, 77, 78, 595, 604, 607-610, 475, 476, 477, 544, 554

[56] References Cited

U.S. PATENT DOCUMENTS 4,206,552 6/1980 Pomerantz et al. ..... 34/48 X

FOREIGN PATENT DOCUMENTS 50-2294 1/1985 Japan .

38797 2/1991 Japan .

*Primary Examiner*—Denise L. Gromada

[57] ABSTRACT

A drying machine has a drying chamber for drying an article cleaned with an inflammable solvent as a detergent. A hot air supply channel communicates with the drying chamber and a heater is mounted in the hot air supply channel. A hot air evacuation channel communicates with the drying chamber and a hot air transfer device is mounted at a voluntary portion of the hot air supply channel and the hot air evacuation channel. A control device is provided for driving control of the heater. A first temperature sensor is mounted on the downstream side of the heater in the hot air supply channel and a second temperature sensor is mounted at a position shifted to the drying chamber in the hot air evacuation channel. The control device controls the heater so that the difference in the temperature detected by the first temperature sensor and the temperature detected by the second temperature sensor is kept within a safe temperature range.

14 Claims, 7 Drawing Sheets

DRYING MACHINE

BACKGROUND OF THE INVENTION

1. Field of the Invention

The present invention relates to drying machines, and more particularly to a drying machine for drying articles such as clothes and semiconductor devices cleaned with an inflammable solvent used as a detergent without catching fire nor causing an explosion.

2. Description of the Prior Art

Drying of clothes cleaned (washed and rinsed) with an inflammable solvent involves a danger that the residual solvent in the clothes catches fire in the drying operation at a high temperature. Thus Japanese Unexamined Patent Publication No. SHO 60-2294/ 1985 proposes a clothes drying machine providing a gas sensor on the side of a gas evacuation channel at the outlet of a drying chamber. The gas sensor checks the clothes to be dried for the presence of a solvent gas to distinguish whether the clothes are cleaned with such solvent or with water. When the gas sensor detects the solvent gas, the drying machine dries clothes at a low temperature, thereby preventing clothes from catching fire and being involved in an explosion. Gas sensors for use in such clothes drying machines include a semiconductor type and a contact combustion type.

In addition, Japanese Patent Publication No. HEI 3-8797 proposes a clothes drying machine for drying clothes at a temperature lower than the ignition temperature of the inflammable solvent to inhibit a danger of catching fire and causing an explosion.

Any kind of gas sensor mounted in the former type of clothes drying machine is constituted so that it can detect the presence of gas by heating the detecting part of the gas sensor. Thus the detecting part of the gas sensor is very likely to catch fire. It means that a fire preventing means having an explosion resistant structure must be installed in the housing chamber of the gas sensor. Clothes drying machines are getting more and more complicated in structure and expensive in price. Furthermore, the gas sensor is exposed to the solvent gas for many hours. The gas sensor has a drawback of lacking in reliability since the solvent gas corrodes the gas sensor, which deteriorates the durability thereof and the precision in the detecting capabilities.

On the other hand, the latter type of clothes drying machine has a drawback that the drying operation is prolonged because clothes are dried at a low temperature even if such drying machine is safe and free from a danger of catching fire and causing an explosion.

Many such problems appear in the same manner when various kinds of semiconductor devices are cleaned with an inflammable solvent.

SUMMARY OF THE INVENTION

The present invention provides a drying machine which comprises:

a drying chamber for drying an article cleaned with an inflammable solvent as a detergent;

a hot air supply channel communicating to the drying chamber;

a heater mounted in the hot air supply channel;

a hot air evacuation channel communicating to the drying chamber;

hot air transfer means mounted at a voluntary portion of the hot air supply channel and the hot air evacuation channel; and control means for driving control of the heater;

a first temperature sensor mounted on the downstream side of the heater in the hot air supply channel; and a second temperature sensor mounted at a position shifted to the drying chamber in the hot air evacuation channel;

wherein the control means controls the heater so that the difference in the temperature detected by the first temperature sensor and the temperature detected by the second temperature sensor is kept within the scope of a safe temperature difference.

The above construction allows control of the drying temperature with a temperature sensor without using a gas sensor. Thus it can provide a cheap drying machine without providing a fire preventing structure complicated with a anti-explosion structure. In addition, the solvent gas does not deteriorate the temperature sensor so that the detection precision is not damaged and the sensor has no danger of catching fire. Moreover, controlling the difference between the temperature of the hot air supplied to the drying chamber and the counterpart of the hot air evacuated from the drying chamber within the scope of the safe temperature difference allows a safe control of the hot air temperature so that the difference between the two hot air temperatures does not exceed the safe temperature difference.

From another viewpoint, the present invention provides a drying machine which comprises:

a drying chamber for drying an article cleaned with an inflammable solvent as a detergent;

a hot air supply channel communicating to the drying chamber;

a heater mounted in the hot air supply channel;

a hot air evacuation channel communicating to the drying chamber;

hot air transfer means mounted at a voluntary portion of the hot air supply channel and the hot air evacuation channel; and control means for driving control of the heater;

a first temperature sensor mounted on the downstream side of the heater in the hot air supply channel;

a second temperature sensor mounted at a position shifted to the drying chamber in the hot air evacuation channel;

a hot air circulating channel provided between the hot air supply channel and the hot air evacuation channel and communicating to the hot air supply channel and the hot air evacuation channel;

a condenser mounted in the hot air circulating channel; and a third temperature sensor mounted on the downstream side of the condenser to detect the temperature of the air after condensation;

wherein the control means determines the gas concentration of the inflammable solvent gas at the hot air circulating channel based on the temperature detected by the third temperature sensor to control the heater so that the safe temperature difference is calculated from the difference between the determined gas concentration and the predetermined safe gas concentration and the difference between the temperature detected by the first sensor and the temperature detected by the second sensor is kept under the safe temperature difference.

In the above construction, the gas concentration of the solvent gas included in the hot air after the solvent is recycled is determined from the temperature of the hot air after condensation so that a safe temperature difference is calculated to control the hot air temperature safely.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be detailed by way of embodiments in conjunction of the accompanying drawings which are given by way of illustration only, and thus are not limitative of the present invention, and wherein.

DETAILED DESCRIPTION OF THE PREFERRED EMBODIMENTS

The present inventors perceived the facts that the ignition point of an inflammable solvent used for cleaning articles is correlated with the gas concentration of the solvent, evaporation of the solvent reduces to a certain degree the temperature of a hot air for drying articles, and the thermal energy required for evaporating the solvent can be calculated. Then they came up with the idea that clarifying the thermal energy enables the calculation of the reduced temperature of the hot air supplied to a drying chamber for housing articles to be dried, and then evacuated from the drying chamber. They, hence, thought that a basis for controlling the drying operation free from catching fire and causing an explosion can be formed by comparing the lowered temperature of the hot air with the safe temperature difference.

In other words, it is possible to control the drying operation without catching fire and causing an explosion by providing the drying machine with two temperature sensors, one detecting the temperature of the hot air supplied to the drying chamber, the other detecting the temperature of the hot air evacuated from the drying chamber, thereby controlling the difference between the two temperatures so that the difference between the two hot air temperatures is less than the above lowered temperature of the hot air. Based on such hypothesis, the present invention has been completed after many trials and errors.

Embodiments described hereinbelow verify that the above hypothesis and assumption are correct.

According to the present invention, the drying machine is intended to be mainly used in drying an article cleaned with an inflammable solvent as a detergent, but washing an article with the inflammable solvent is not excluded. Here, a clothes drying machine will be taken as an example Embodiments of the clothes cleaning and drying machine will be detailed in conjunction with the accompanying drawings.

Figure 5:
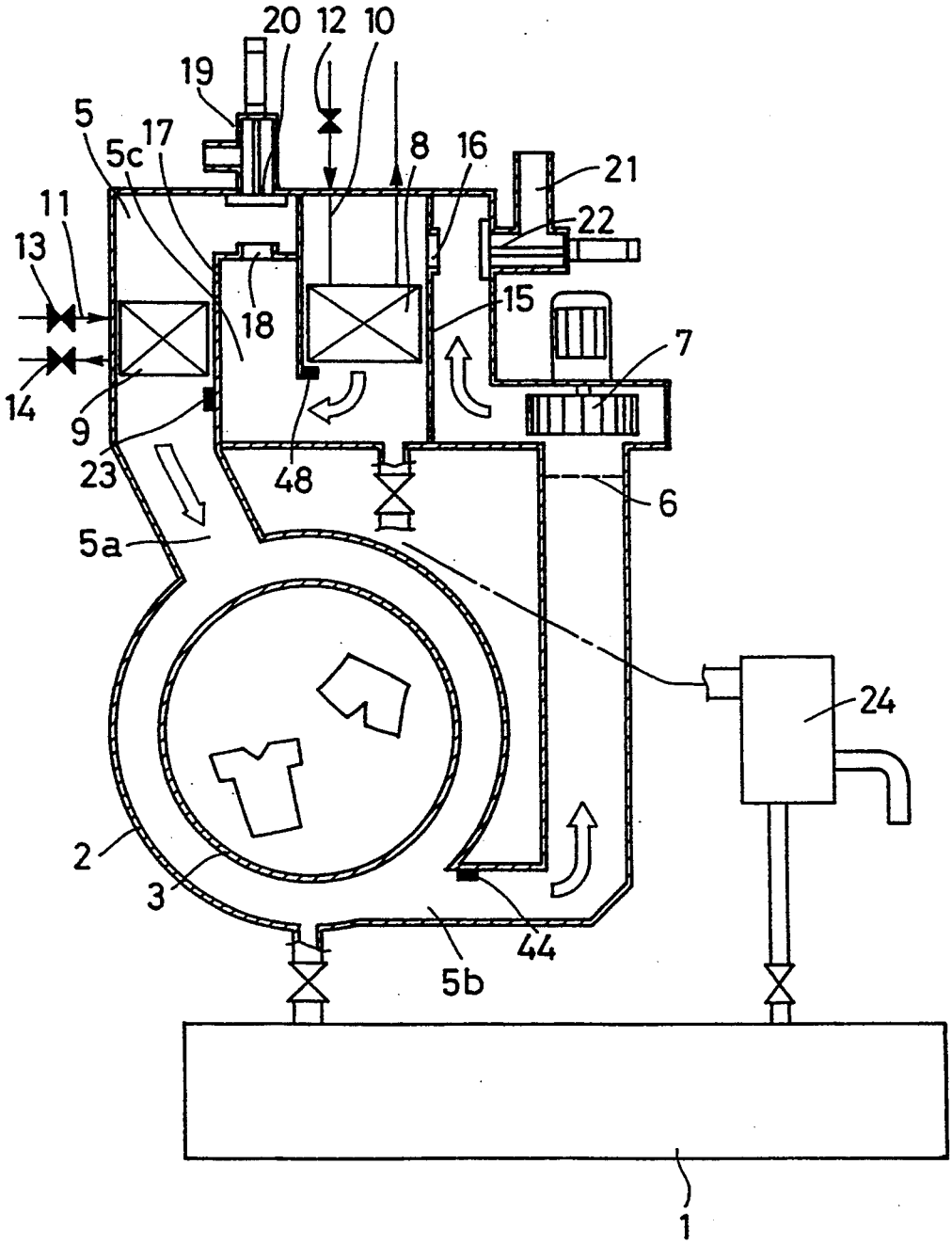
FIG. 5 is a view illustrating the internal construction of Embodiments 1 through 3 of the clothes drying machine in accordance with the present invention.

FIG. 5 shows an internal construction of a clothes cleaning and drying machine in accordance with the present invention. Referring to FIG. 5, a solvent tank 1 which contains e.g., an inflammable petroleum solvent (Industrial Gasoline No. 5) which may further contain a detergent such as soap and the like, a housing basin 2 arranged above the solvent tank 1, and a drum 3 serving as a drying chamber. The drum 3 is rotatably arranged in the housing basin 2 and has a plurality of holes on the surrounding wall thereof, wherein clothes are housed as an article to be cleaned and dried.

The solvent in the solvent tank 1 is transported into the housing basin 2 via a solvent feeding channel not shown in the drawings. Then the drum 3 rotates to clean (wash and rinse) clothes in the drum 3. Then after the solvent in the housing basin 2 is carried back to the solvent tank 1, the drum 3 rotates at a high speed to remove the solvent absorbed in the clothes with a centrifugal force.

A hot air channel 5 circulates the hot air for drying clothes in the drying operation. The hot air channel 5 comprises a hot air supply channel **5*a* communicating with the upper portion of the housing basin 2, a hot air evacuation channel 5*b* communicating to the lower portion of the housing basin 2, and a hot air circulating chamber 5*c* connecting the hot air supply channel 5*a* to the hot air evacuation channel 5*b*. An arrow in FIG. 5 designates the direction of the stream of the hot air circulating through the hot air channel 5. Inside of the hot air channel 5 is arranged a lint filter 6, an air blower 7 as a hot air transfer means, a condenser 8, and a heater 9 from the side of the hot air evacuation channel 5*b* in this order. Cool water is supplied to the condenser 8 from a cooling pipe 10. The heater 9 is heated by steam supplied from a steam pipe 11**.

A valve 12 is disposed in the cooling pipe 10, a steam introducing valve 13 is disposed in the steam pipe 11, a steam evacuation valve 14 is disposed in the steam pipe 11, and a partition wall 15 partitioning the air blower 7 and the condenser 8 is provided. The partition wall 15 has a communication hole 16. A shielding wall 7 shields the condenser 8 and the heater 9 in the hot air channel 5. The shielding wall 17 has a communicating hole 18.

An air intake duct 19 introduces air from the outside between the condenser 8 and the heater 9. The duct 19 is opened and closed with an air intake valve 20. The air intake valve 20 opens the air intake duct 19 and closes the communication hole 18 at the same time. An air evacuation duct 21 for discharging the hot air in the hot air channel 5 to the outside is provided. The air evacuation duct 21 is opened and closed with an air evacuation valve 22. The air evacuation valve 22 opens the air evacuation duct 21 and closes the communicating hole 16 at the same time. A water separator 24 communicates with the lower part of the condenser 8, the water separator 24 serving as a means for recycling solvent condensed with the condenser 8 to separate it into water and solvent by using the difference in gravity so that only the solvent is carried back to the solvent tank 1.

A supplied hot air temperature sensor 23 serves as a first temperature sensor comprising a negative characteristic thermistor attached on the hot air supply channel 5*a* between the heater 9 and the housing basin 2. An evacuated hot air temperature sensor 44 serves as a second temperature sensor comprising a negative characteristic thermistor attached on the hot air evacuation channel 5*b* in the neighborhood of the housing basin 2. A condensed air temperature sensor 48 serves as a third temperature sensor comprising a negative characteristic thermistor attached on the downstream portion of the hot air circulating channel 5*c* in the neighborhood of the condenser 8, the sensor detecting the temperature of the condensed air after passing through the condenser 8.

Figure 6:
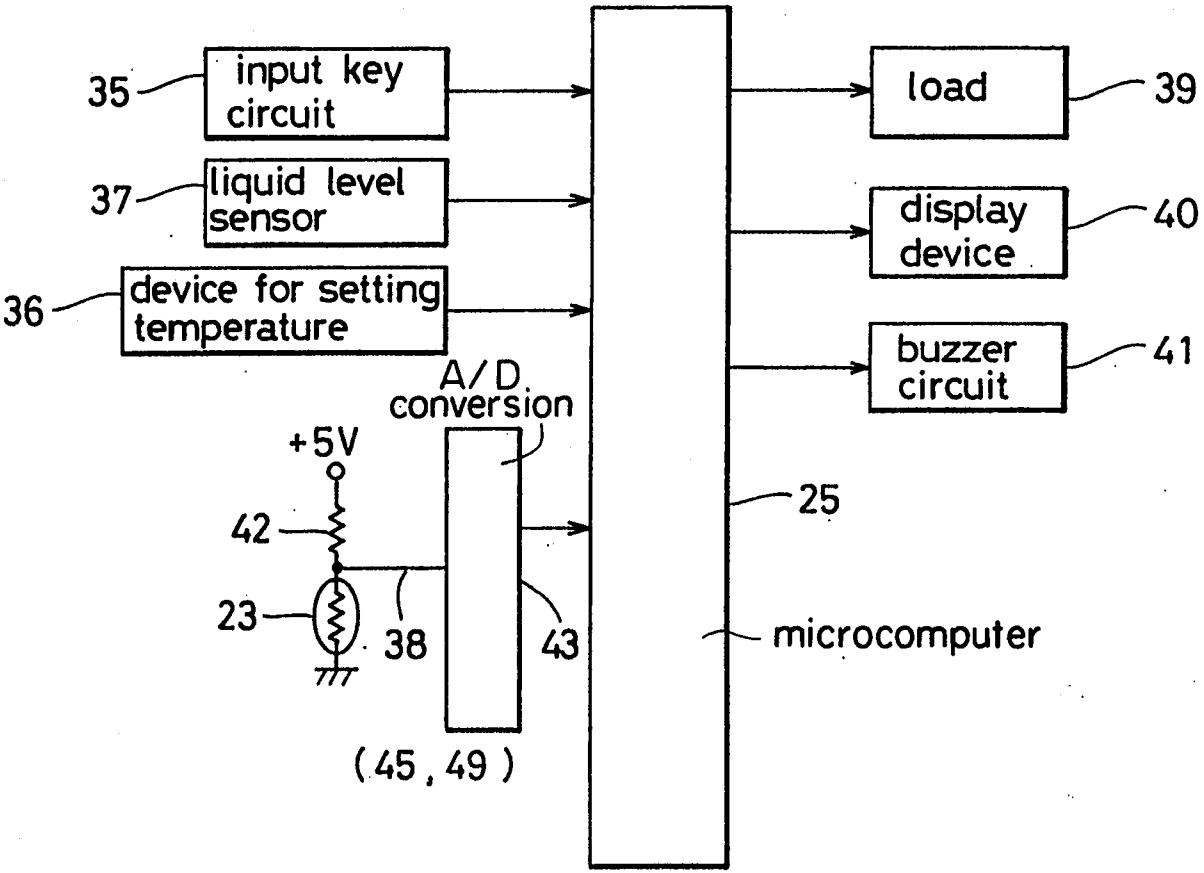
FIG. 6 is a block diagram of a control mechanism in Embodiments 1 through 3 of the clothes drying machine in accordance with the present invention.
Figure 7:
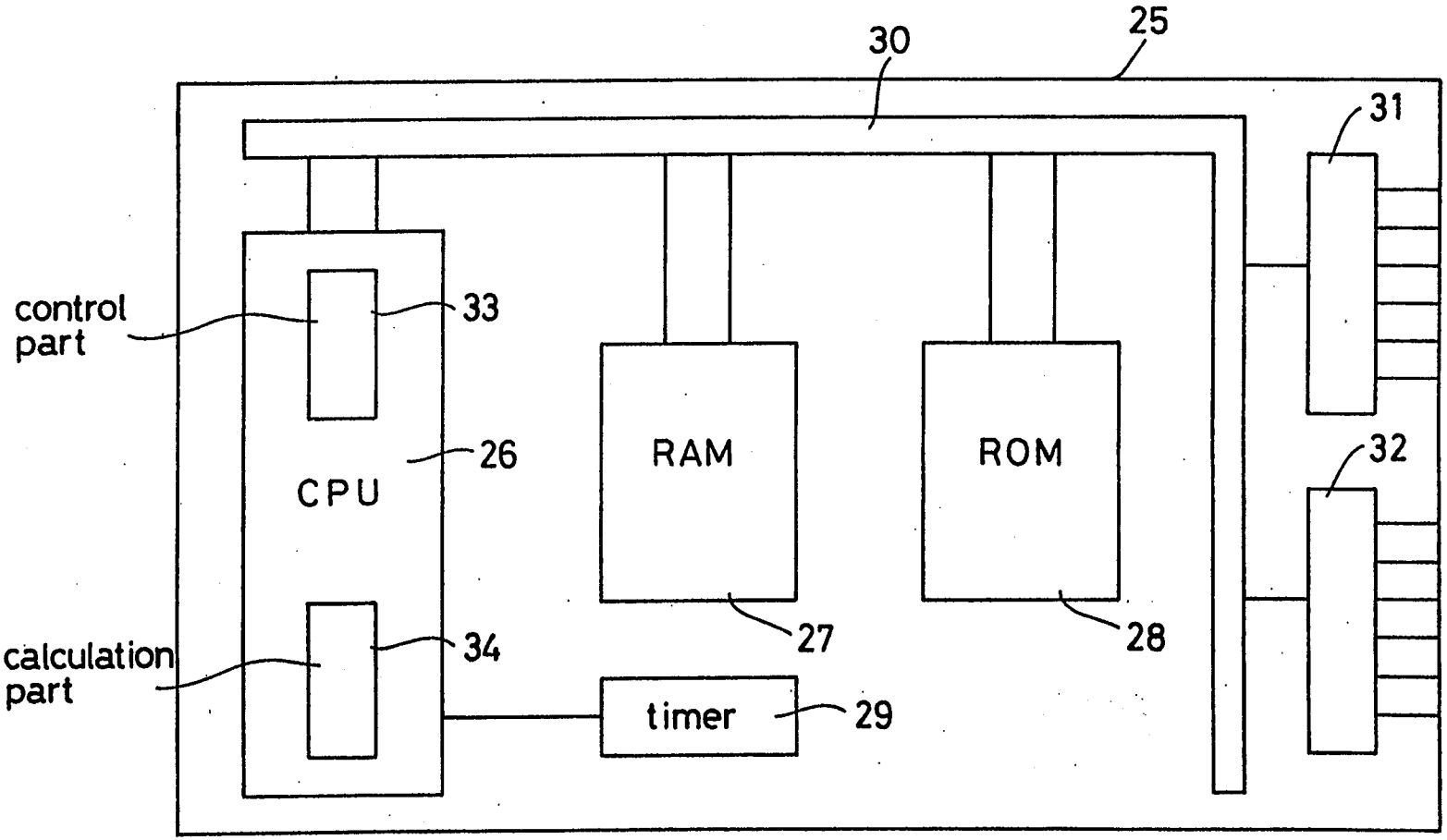
FIG. 7 is a block diagram of a microcomputer in the control mechanism in Embodiments 1 through 3 of the clothes drying machine in accordance with the present invention.

In FIG. 6, a microcomputer 25 is a control means. As shown in FIG. 7, the microcomputer 25 comprises a central processing unit (CPU) 26, a random access memory (RAM) 27, a read only memory (ROM) 28, a timer 29, a system bus 30, and input/output ports 31, 32.

The CPU 26 comprises a control part 33 and a calculation part 34. The control part 33 fetches and executes instructions. The calculation part 34 performs operations such as binary addition, logical operation, addition and subtraction, comparison and the like with a control signal with respect to data given from an entering device and a memory. The RAM 27 stores data concerning the drying machine. The ROM 28 stores such data as means for operating the drying machine in advance, conditions set for determination, and rules for treating each kind of data.

The microcomputer 25, as shown in FIG. 6, controls the behavior of a load 39 such as each kind of on-off valves 12, 13, 14, 20 and 22, a motor and an air blower 7, a display device 40 and a buzzer circuit 41 based on information entered from an input key circuit 35 constituted of each kind of operation key group, a device for setting temperature 36, a liquid level sensor 37, the first temperature detector 38 and the like.

The first temperature detector 38 enters a voltage value determined by the resistance values of resistance 42 and the supplied hot air temperature sensor 23 to the microcomputer 25 via an A/D conversion circuit 43.

The second temperature detector 45 and the third temperature detector 49 have the same construction as the first temperature detector 38, but their resistance values are rendered different from each other. The second temperature detector 45 enters a voltage value determined by the resistance values of the resistance 42 and the evacuated hot air temperature sensor 44 to the microcomputer 25 via an A/D conversion circuit 43. In addition, the third temperature detector 49 enters a voltage value determined by the resistance values of the resistance 42 and the condensed hot air temperature sensor 48 via an A/D conversion circuit 43.

Then the microcomputer 25 functions to control the drying temperature by comparing signal values transmitted from these temperature detectors 38, 45 and 49 with reference values stored in the ROM 28.

The device 36 for setting temperature serves as a means for setting in advance the temperatures of the hot air supply channel 5*a* and the hot air evacuation channel 5*b* within the scope of the safe temperature difference. The operation is performed with ten keys 0 through 9. The temperature set with this device for setting temperature 36 is stored in RAM 27 in the microcomputer 25.

This embodiment of the clothes cleaning and drying machine has the above construction to perform consecutively a cleaning program comprising the steps of cleaning (washing and rinsing) clothes, removing the used solvent, and drying cleaned clothes under the control of the microcomputer 25.

At the outset, the following passage details physical characteristics of the Industrial Gasoline No. 5, one of a typical inflammable petroleum solvent used for dry cleaning.

For example, in the case of drying clothes cleaned with a solvent having a molecular weight of 143, an ignition point of 43° C., an explosion lower limit gas concentration of 0.6 vol % and an evaporation heat of 80 kcal/kg, the explosion lower limit gas concentration requires to be controlled at or under 0.6 vol % as a safe gas concentration.

The gas concentration of 0.6 vol % means that 1 $m^3$ of air contains 6 liters (about 33 g) of the solvent. Calculating the thermal energy required for evaporating the solvent contained in such hot air for drying clothes shows that the thermal energy of about 2.4 kcal is needed for the above purpose. Then the hot air temperature for drying clothes can be calculated to lower by about 8° C. Consequently, the supplied hot air temperature can be increased by about 8° C. with respect to the evacuated hot air temperature.

Thus the hot air temperature is controlled so that the supplied hot air temperature in the basin is 8° C. higher than the evacuated hot air temperature, a safe operation of the drying machine can be secured. In other words, 8° C. can form a reference value as a safe temperature difference that can be used in controlling the drying operation.

Figure 4:
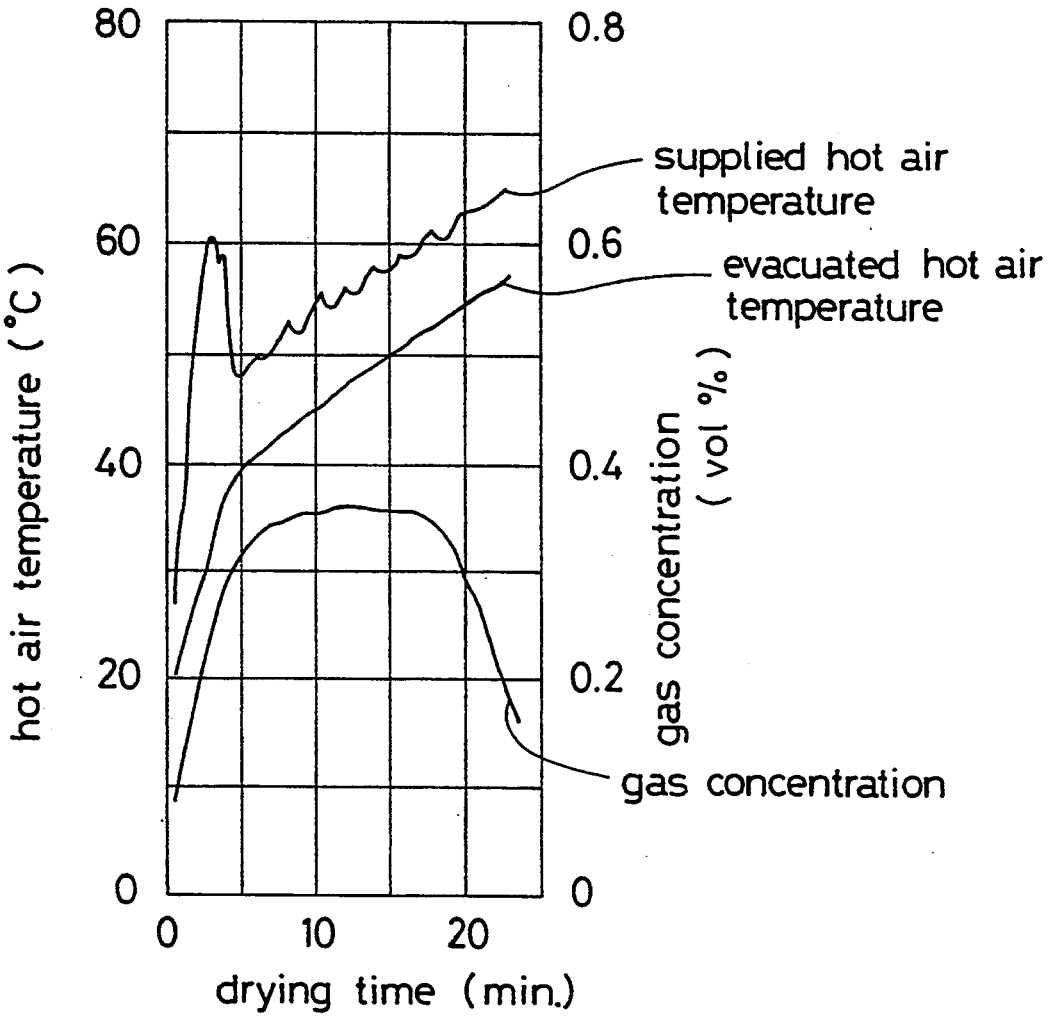
FIG. 4 is a view showing the relation among a gas concentration of a solvent gas, a hot air temperature and a drying treatment time in Embodiments 1 through 3 of the clothes drying machine in accordance with the present invention.

FIG. 4 shows relations among the supplied hot air temperature, evacuated hot air temperature and the solvent gas concentration in the housing basin 2, which all change with the lapse of drying time. In particular, FIG. 4 shows data on drying experiment under the following conditions; an indoor temperature of 20° C., a supplied hot air temperature of 60° C., an amount of blown air of 20 $m^3$/min., a load of 25 kg, a solvent content of 4 kg.

As can be seen from FIG. 4, when the difference between the supplied hot air temperature and the evacuated hot air temperature at about 8° C., it is possible to suppress the solvent gas concentration in the housing basin 2 to 0.6 vol %.

Figure 1:
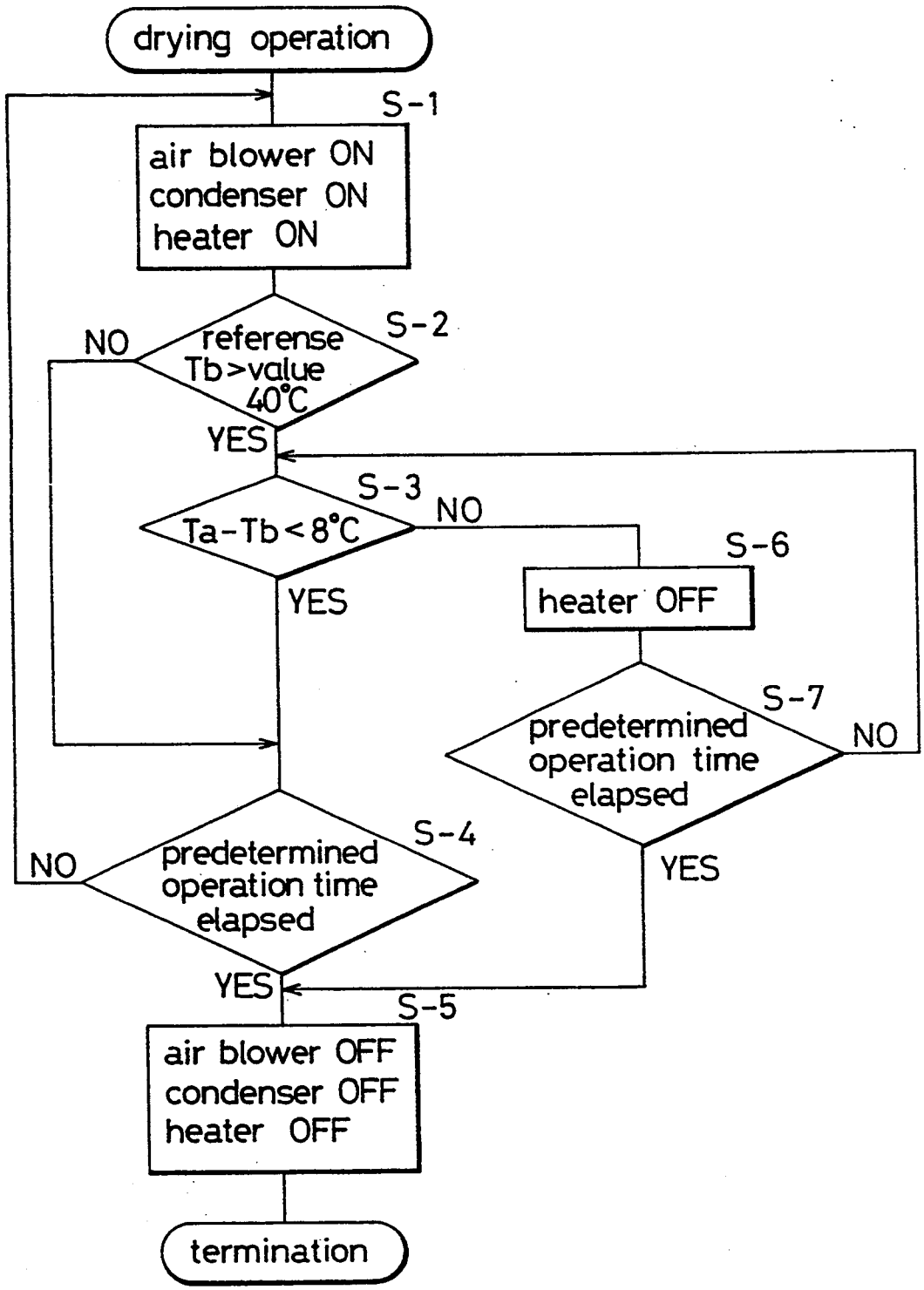
FIG. 1 is a flow chart showing a clothes drying operation in Embodiment 1 of a clothes drying machine in accordance with the present invention.
Figure 2:
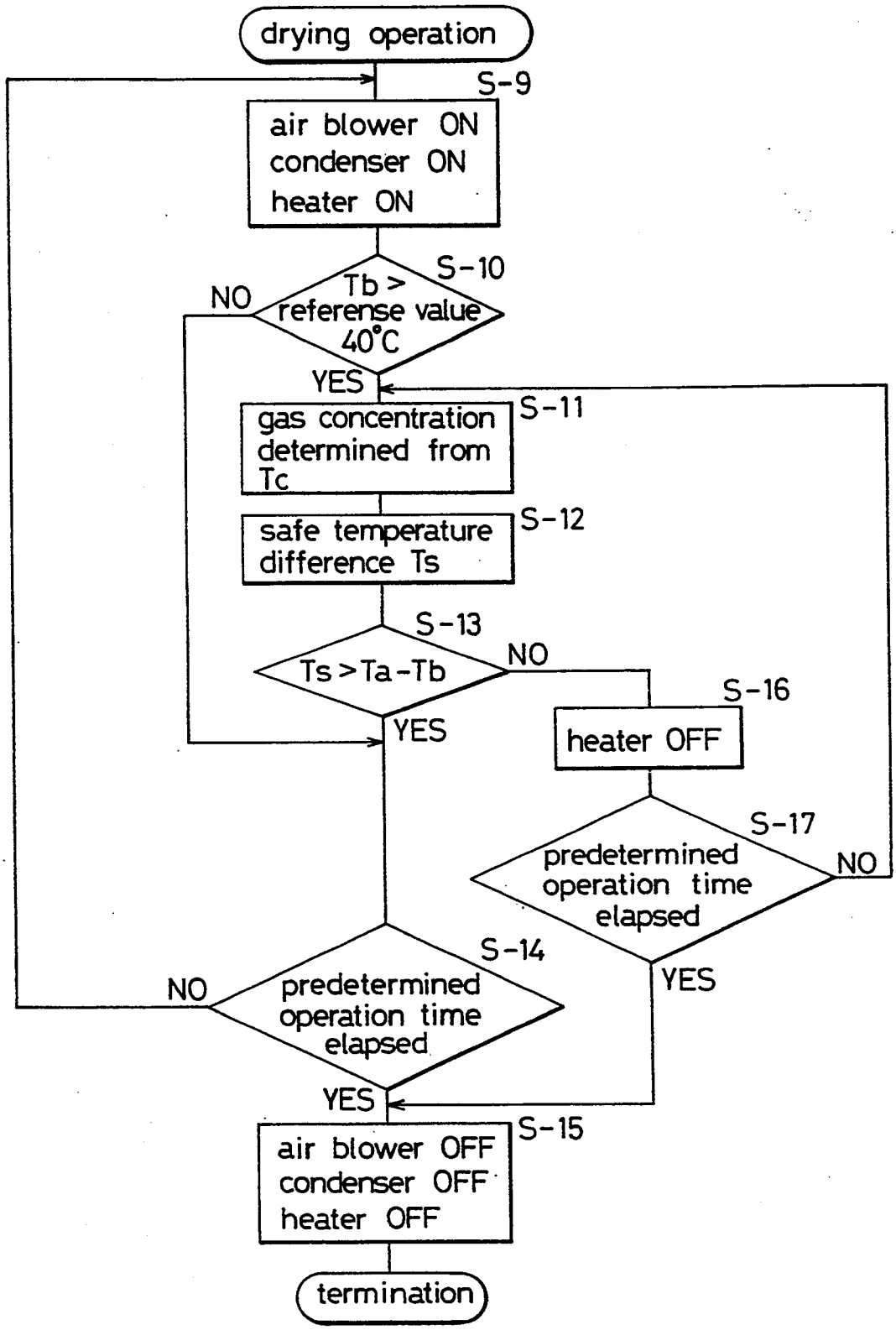
FIG. 2 is a flow chart showing a clothes drying operation in Embodiment 2 of the clothes drying machine in accordance with the present invention.
Figure 3:
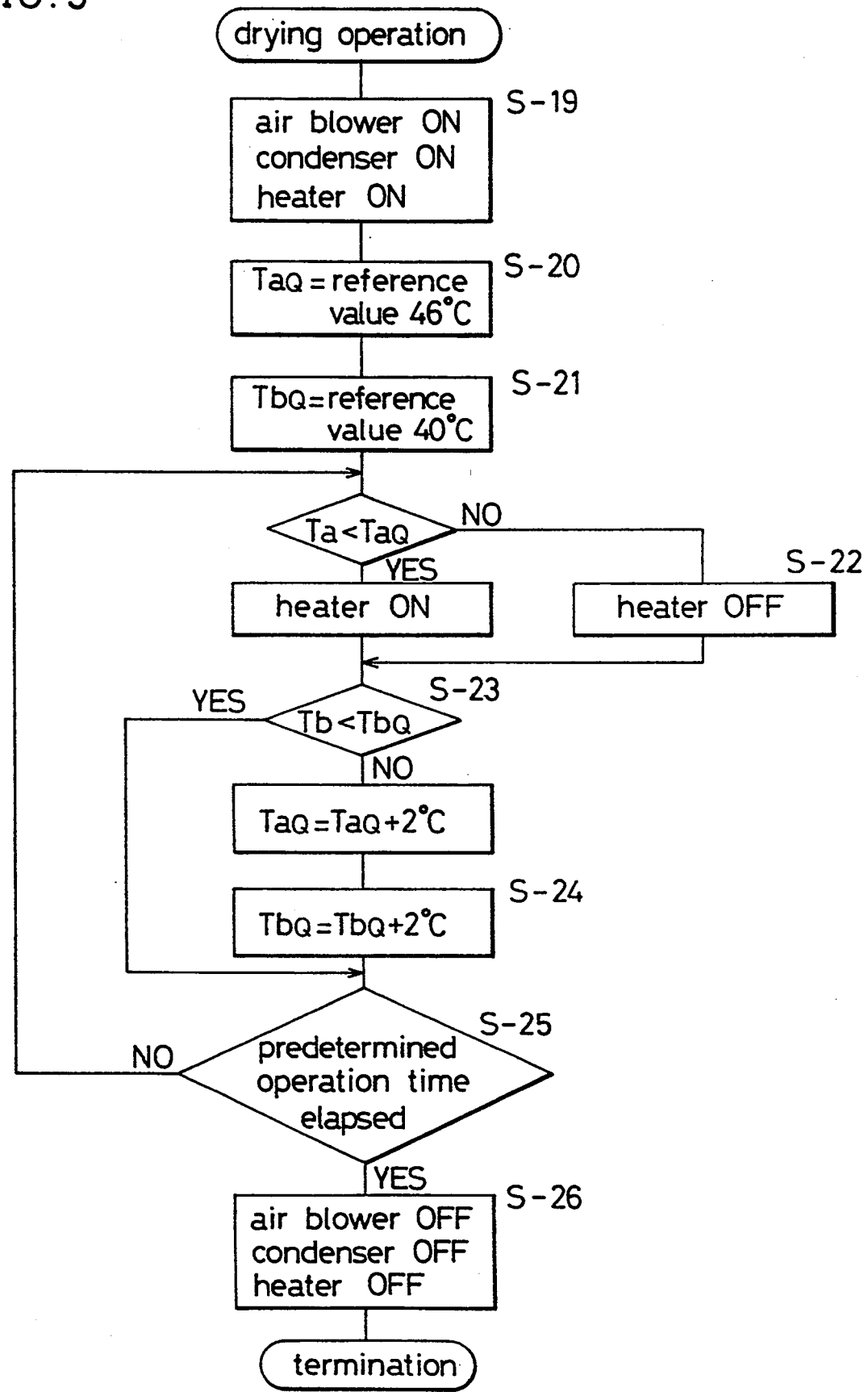
FIG. 3 is a flow chart showing a clothes drying operation in Embodiment 3 of the clothes drying machine in accordance with the present invention.

Next, the behavior of the drying operation by three different kinds of technical means will be detailed by way of FIGS. 1 through 3.

Embodiment 1

FIG. 1 is a flow chart of a control by the first technical means. The flow chart can apply both to the solvent recycling and solvent non-recycling methods. The solvent recycling method recycles a solvent by circulating the hot air for drying operation whereas the solvent non-recycling method does not recycle a solvent, thereby evacuating it without circulating the hot air for drying operation. Out of the two methods, the solvent recycling method will be detailed hereinbelow.

Petroleum solvents have an ignition point of 43° C., and the saturated gas concentration at the ignition point is equal to the explosion lower limit gas concentration. Consequently, when the evacuated hot air temperature stands at 43° C. or less, the solvent gas concentration does not exceed the explosion lower limit gas concentration of 0.6 vol %.

The initiation of the drying operation actuates an air blower 7, a condenser 8 and a heater 9 to circulate hot air for drying articles into a housing basin 2 and a hot air channel 5 (S-1). Along with such operation, a device 36 for setting the temperature sets the reference value for the evacuated hot air temperature Tb to 40° C. in consideration of the ignition point, thereby driving the drying machine (S-2).

Then a comparison is made between the safe temperature difference of 8° C. and the difference (Ta−Tb) between the supplied hot air temperature Ta detected by a temperature sensor for the supplied hot air 23 and the evacuated hot air temperature Tb detected by a temperature sensor for the evacuated hot air 44 (S-3). When the difference (Ta−Tb) is lower than 8° C., the drying machine is driven until a predetermined operation time elapses since the above difference ranges within the scope of the safe temperature (S-4). After the predetermined operation time elapses, the air blower 7, the condenser 8 and the heater 9 are turned off (S-5) to terminate the drying operation.

However, when the above difference (Ta−Tb) is either equal to or higher than the safe temperature difference of 8° C., the heater 9 is turned off (S-6). Then the microcomputer 25 judges whether or not a predetermined operation time has elapsed (S-7). When the microcomputer 25 judges that the drying operation has continued for the predetermined operation time, the air blower 7 and the condenser 8 are turned off to terminate the drying operation. When the microcomputer 25 judges that the predetermined operation time has not elapsed, the whole process of operation return to S-3.

Thus the difference between the supplied hot air temperature Ta and the evacuated hot air temperature Tb is compared with the safe temperature difference, and the above difference is controlled within the safe temperature difference. As apparent from FIG. 4, even if the evacuated hot air temperature exceeds the ignition point of 40° C., the supplied hot air temperature Ta can be set to a higher level as long as the above difference ranges within the scope of the safe temperature of 8° C. Then the gas concentration can be kept less than 0.6 vol % so that the danger of catching fire and causing an explosion disappears.

A gradual increase in the supplied hot air temperature Ta on the presupposition that drying machine is controlled within the safe temperature difference makes it possible to promote the evaporation of the solvent from the early stage in the drying operation. This, in turn, makes it possible to introduce evaporated solvent into the hot air evacuation channel **5*b* very safely, thereby condensing the solvent with the condenser 8 to be removed and recycled. Incidentally, a clothes cleaning and drying machines with no hot air circulating channel 5*c* including a condenser 8** provided only evacuates evaporated solvent out of the drying machine.

Embodiment 2

A second technical means is suitable to the solvent recycling method which recycles a solvent by circulating the hot air for drying operation. FIG. 2 is a flowchart of the control in Embodiment 2. S-9 corresponds to S-1 in FIG. 1, S-10 to S-2 in FIG. 2. Thus detailed explanation will start with S-11.

At S-10, the evacuated hot air temperature Tb is compared with the reference value of 40° C. When the evacuated hot air temperature Tb exceeds 40° C., the temperature Tc of the condensed air after passing through the condenser 8 is detected with the condensed air temperature sensor 48. The gas concentration is determined from the condensed air temperature Tc (S-11). In other words, when the temperature of the condenser 8 stands at T° C., the temperature of the solvent gas after passing through the condenser 8 also stands at a saturated point of T° C. The solvent gas has a saturated steam pressure Pt corresponding to T° C. When an external pressure (air pressure in the drying air channel approximately equal to the atmospheric pressure) is designated by P, the solvent gas concentration after passing through the condenser 8 can be designated by Pt/P. Consequently, the gas concentration of the hot air for drying operation before being blown to the heater 9 circulating hot air can be determined by the temperature of the condensed air Tc at the temperature sensor 48 after passing through the condenser 8 as long as the external pressure remains constant.

In correspondence to the explosion lower limit gas concentration of 0.6 vol % (safe gas concentration) in the above standard solvent, a safe temperature difference (8° C.) is calculated to provide the basis of a safety operation. Then from the explosion lower limit gas concentration of 0.6 vol %, a residual solvent gas concentration determined from the temperature Tc after passing through the condenser 8 is subtracted. The difference in gas concentration thus obtained is converted into a safe temperature difference Ts on the basis of the temperature per unit gas concentration of the solvent (about 0.1 vol %=1.33° C.) (S-12).

The safe temperature difference Ts is compared with the difference in the hot air temperature obtained by subtracting the evacuated hot air temperature Tb from the supplied hot air temperature Ta (S-13). When the difference in the hot air temperature (Ta−Tb) is lower than the safe temperature difference Ts, the drying machine is driven until a predetermined operation time (S-14). When the predetermined operation time elapses, the air blower 7, the condenser 8 and the heater 9 is turned off (S-15) to terminate the drying operation.

When either the difference in the hot air temperature (Ta−Tb) is higher than the safe temperature difference Ts or when both temperatures are the same in the comparison between the two (S-13), the heater 9 is turned off (S-16). Later the microcomputer 25 judges how many time the drying operation has continued (S-17). When it judges that the operation continue for the predetermined operation time, the air blower 7 and the condenser 8 are turned off (S-15) to terminate the drying operation. When the microcomputer 25 judges that the operation does not continue for the predetermined operation time, the whole process returns to S-11.

As mentioned above, the concentration of the solvent gas contained in the condensed air is determined from the temperature Tc of the condensed air after passing through the condenser 8. Then the safe temperature difference Ts is calculated from the concentration of the solvent gas and the safe gas concentration of 0.6 vol %. In other words, the supplied hot air temperature Ta is controlled in consideration of the gas concentration contained in the condensed air. Then the drying operation is conducted by comparing the hot air temperature difference with the safe temperature difference Ts so that the hot air temperature difference is kept within the scope of the safe temperature difference Ts. This provides a higher precision in the safety control.

Embodiment 3

The third technical means will be detailed hereinbelow which can be commonly used both in the solvent recycling and solvent non-recycling methods; the solvent recycling method recycles the solvent by circulating the hot air for drying operation and the solvent non-recycling method evacuates the hot air for drying operation without circulating it and does not recycle the solvent. FIG. 3 shows a flowchart of the control by means of the third technical means. The drying operation is initiated with driving an air blower 7, a condenser 8 and a heater 9 (S-19).

When the basic value of 8° C. is adopted as a safe temperature difference, the supplied hot air temperature Ta rises more quickly than the evacuated hot air temperature Tb once the drying operation initiates so that the safe temperature difference cannot be kept correctly. In the control method of the present invention, when the evacuated hot air temperature Tb attains a reference value with the safe temperature difference kept, the set values for both the supplied and evacuated hot air temperatures Ta,Tb are raised by a certain value (for example 2° C.) from the reference values thereof, thereby controlling the temperature difference within the safe range.

In other words, even when the supplied hot air temperature Ta abruptly rises by 2° C. after the reference values are changed, the temperature difference is kept in the scope of 8° C. Thus 6° C. in consideration of such abrupt change is adopted as a safe temperature difference. The reference value TaQ for the supplied hot air temperature is set to 46° C. (S-20) whereas the reference value TbQ for the evacuated hot air temperature Tb is set to an ignition point of 40° C. (S-21).

The heating condition is controlled by turning on and off the heater 9 so that the supplied hot air temperature Ta at the initiation of the drying operation does not become higher than the reference value TaQ (S-22). Later, the reference value TbQ is compared with the evacuated hot air temperature Tb (S-23). When the evacuated hot air temperature Tb becomes higher than the reference value TbQ, two reference values TaQ and TbQ are automatically set to a higher value by 2° C. (S-24). Even if the supplied hot air temperature Ta quickly reaches the reference value TaQ, and the evacuated hot air temperature Tb reached the reference value TbQ later than the supplied hot air temperature Ta, the difference between the two hot air temperatures does not exceed 8° C.

Then, when the evacuated hot air temperature Tb becomes higher than the reference temperature TbQ again, the reference value is automatically raised by 2° C. Then after a predetermined operation time elapses (S-25), the air blower 7, a condenser 8 and a heater 9 are turned off (S-26) to terminate the drying operation.

Thus, the reference values are renewed within the scope of the safe temperature difference to gradually raise the supplied hot air temperature Ta with the result that the time required for completing the predetermined dried condition passes, and safe control of the drying operation is made possible.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A drying machine which comprises:

a drying chamber for drying an article cleaned with an inflammable solvent as a detergent;

a hot air supply channel communicating with the drying chamber;

a heater mounted in the hot air supply channel;

a hot air evacuation channel communicating with the drying chamber;

hot air transfer means mounted at a voluntary portion of the hot air supply channel and the hot air evacuation channel;

a first temperature sensor mounted on the downstream side of the heater in the hot air supply channel;

a second temperature sensor mounted at a position shifted to the drying chamber in the hot air evacuation channel; and control means for controlling the heater so that a difference between a temperature detected by the first temperature sensor and a temperature detected by the second temperature sensor is kept within a safe temperature range avoiding detrimental excessive heating of the inflammable solvent.

2. A drying machine which comprises:

a drying chamber for drying an article cleaned with an inflammable solvent as a detergent;

a hot air supply channel communicating to the drying chamber;

a heater mounted in the hot air supply channel;

a hot air evacuation channel communicating to the drying chamber;

hot air transfer means mounted at a voluntary portion of the hot air supply channel and the hot air evacuation channel; and control means for driving control of the heater;

a first temperature sensor mounted on the downstream side of the heater in the hot air supply channel;

a second temperature sensor mounted at a position shifted to the drying chamber in the hot air evacuation channel;

a hot air circulating channel provided between the hot air supply channel and the hot air evacuation channel and communicating to the hot air supply channel and the hot air evacuation channel;

a condenser mounted in the hot air circulating channel; and a third temperature sensor mounted on the downstream side of the condenser to detect the temperature of the air after condensation;

wherein the control means determines the gas concentration of the inflammable solvent gas at the hot air circulating channel based on the temperature detected by the third temperature sensor and calculates the safe temperature difference from the difference between the determined gas concentration and the predetermined safe gas concentration; and the control means controls the heater so that the difference between the temperature detected by the first sensor and the temperature detected by the second sensor is kept within the safe temperature difference.

3. The drying machine of claim 1, wherein said control means is so constituted that the means compares the temperature detected by the first temperature sensor with a reference value for the first temperature sensor so that the heater is either turned on or off depending on the result of the comparison, and said control means compares the temperature detected by the second temperature sensor with a reference value for the second sensor.

4. The drying machine of claim 1, wherein said control means is so constituted that the means compares the temperature detected by the first temperature sensor with a reference value for the first temperature sensor so that the heater is either turned on or off depending on the result of the comparison, and said control means compares the temperature detected by the second temperature sensor with a reference value for the second temperature sensor so that when the detected temperature either equals or exceeds the reference value, the reference value for the first temperature sensor and the reference value for the second temperature sensor are set to a higher level with said safe temperature difference maintained.

5. The drying machine of claim 2, wherein said control means is so constituted that the means compares the calculated safe temperature difference with the temperature difference obtained by subtracting the temperature detected by the second temperature sensor from the temperature detected by the first temperature sensor.

6. The drying machine of either claim 1 or 2, wherein said solvent is industrial gasoline having an ignition point of about 43° C.

7. The drying machine of either claim 1 or 2, wherein said article is clothes and said drying chamber is rotatably housed in the housing basin.

8. The drying machine of either claim 1 or 2, wherein said article is a semiconductor device.

9. The drying machine of claim 1, wherein the first and second temperature sensors comprises a negative characteristic thermistor while said control means comprises a microcomputer providing a central processing unit, a random access memory, a read only memory, a timer, a system bus and input/output ports.

10. The drying machine of claim 2, wherein the first, second and the third temperature sensors comprises a negative characteristic thermistor while said control means comprises a microcomputer providing a central processing unit, a random access memory, a read only memory, a timer, a system bus and input/output ports.

11. The drying machine of claim 1, wherein said safe temperature difference in the control means stands at about 8° C.

12. The drying machine of claim 2, wherein the predetermined safe gas concentration in the control means stands at 0.6 vol %.

13. The drying machine of claim 5, wherein reference value for the first temperature sensor stands at about 46° C., and the reference value for the second sensor stands at about 40° C.

14. The drying machine of claim 6, wherein said safe temperature difference in said control means is about 6° C., a reference value for the temperature difference detected by the first sensor is about 46° C., the a higher reference value for the same is about 48° C., a reference value for the temperature detected by the second temperature sensor is about 40° C., and a higher reference value for the same is about 42° C.

* * * * *